US005665161A

United States Patent [19]

Milliman et al.

[11] Patent Number: 5,665,161

[45] Date of Patent: Sep. 9, 1997

[54] CROSS-HEAD DIE APPARATUS

[75] Inventors: James A. Milliman, Rome, N.Y.; Gary G. Thuot, St. Albans, Vt.

[73] Assignee: Belden Wire & Cable Company, Richmond, Ind.

[21] Appl. No.: 705,323

[22] Filed: Aug. 29, 1996

Related U.S. Application Data

[63] Continuation-in-part of Ser. No. 398,513, Feb. 28, 1995, abandoned.

[51] Int. Cl.[6] ..... B05C 3/00

[52] U.S. Cl. ..... 118/405; 118/419; 118/420; 118/DIG. 18; 118/DIG. 19; 425/113

[58] Field of Search ..... 118/405, 419, 118/420, DIG. 18, DIG. 19; 425/113

[56] References Cited

U.S. PATENT DOCUMENTS

| | | | |
|---|---|---|---|
| 5,031,568 | 7/1991 | Milliman | 425/113 |
| 5,316,583 | 5/1994 | Milliman | 118/405 |

FOREIGN PATENT DOCUMENTS

| | | | |
|---|---|---|---|
| 1504937 | 6/1969 | Germany | 425/113 |
| 8911961 | 12/1989 | WIPO | 425/113 |

*Primary Examiner*—Laura Edwards

*Attorney, Agent, or Firm*—Laff, Whitesel, Conte & Saret, Ltd.

[57] ABSTRACT

Cross-head die apparatus and method for applying visually distinguishable coating layers simultaneously to two filament members such as electrical wires. The apparatus includes a body having a pair of generally axial bores and a pair of radial bores respectively communicating between sources of first and second flowable coating materials and the axial bores. A flow guide to direct the coating materials through the axial bores to form uniform layers on wires moved axially through the bores. The two axial bores mutually communicate through an internal conduit, coaxial with the two radial bores, in the body. The two coating materials are supplied at different pressures, causing a portion of the first material to migrate through the internal conduit from one axial bore to the other, whereby the first material forms the entire coating layer on one wire and appears, together with the second material, as a longitudinal stripe in the coating layer on the other wire.

10 Claims, 6 Drawing Sheets

CROSS-HEAD DIE APPARATUS

This is a continuation-in-part application of U.S. application Ser. No. 08/398,513 filed Feb. 28, 1995 now abandoned.

BACKGROUND OF THE INVENTION

The present invention relates to extrusion dies of the cross-head type for applying uniform layers of coating materials to elongated, filament members, and more particularly to cross-head die apparatus for simultaneously applying visually distinguishable coating layers to a plurality of filament members. The invention also relates to methods thereof.

Electrical wires, optical fibers, and other elongated, filament members are commonly provided with coatings for insulating, shielding, and other purposes by an extrusion process utilizing apparatus known as a cross-head die. For purposes of discussion, it will be assumed that the members to be coated are electrical conductors, although it will be understood that the invention is not limited to employment with that type of filament members. The coating material is commonly an appropriate type of plastic and, in any case, is applied to the wire while in a molten or otherwise flowable condition.

Typical cross-head dies include a body portion having a through axial bore with which a radial bore communicates on one side. The wire is moved longitudinally through the axial bore, wherein its axis of travel is established by appropriate guide means, as the flowable coating material is injected through the radial and into the axial bore. Structure within the axial bore established a flow path causing the coating material to pass through an annular orifice, surrounding the wire in an essentially uniform coating as it exits the front end of the axial bore.

When electric wires, and other coated filament members, are placed in use it is often desirable to have some means of visually distinguishing between wires of different gage material or other physical or electrical properties, or simply to be able to identify individual wires of a group of wires at various points along their length. The coating materials may be color-coded to provide this attribute. Also, since the number of solid colors is limited, it is a common practice to provide multi-colored coating layers on a single wire. A layer including longitudinally extending, circumferentially distinct portions of different colors may be applied in a cross-head die by providing a plurality of radially extending bores communicating with the same axial bore at different positions about the periphery thereof. Of course, the coating materials injected through all of the radial bores are applied to only the single wire which is moved through the axial bore with which the radial bores communicate.

In some cross-head dies, two or more axial bores may be provided in the die body to permit simultaneous coating of a plurality of wires. At least one radial bore communicates solely with an associated axial bore; more than one radial bore communicates with each axial bore wherein more than one coating material is to be applied to the wire moved therethrough. Thus, while it is possible to coat a plurality of wires simultaneously in a single die body, and to apply multi-color coatings to one or more wires, the number of connections of the vessels containing the coating materials to the die body, and therefore the cost of fabricating the die body, and associated apparatus, increases accordingly.

It is a principal object of the present invention to provide novel and improved apparatus and methods for applying multi-colored coating layers simultaneously to a plurality of wires in a single cross-head die body as set forth in our claims.

Other objects will in part be obvious and will in part appear hereinafter.

SUMMARY OF THE INVENTION

The cross-head die apparatus of the invention includes a cylindrical body member having a plurality of laterally spaced, through bores extending generally axially between rear and front ends of the body member. Each axial bore communicates through an associated radial bore with a source of flowable coating material. In the disclosed embodiment, the body portion includes two axial bores, positioned on opposite sides of the longitudinal centerline, and two radial bores coaxially positioned on diametrically opposite sides of the body portion.

Removably positioned within each axial bore, from front to rear, are a pair of dies, a pair of tips and a pair of tip holders. The tip holders and dies have outer surfaces tapering outwardly from front to rear which are matingly retained in correspondingly tapered, internal surfaces of the axial bores. The tips have rear, outer surface portions tapering inwardly from front to rear which are matingly retained in correspondingly tapered surfaces in the forward portions of through axial bores in the tip holders. The forward portions of the tips extend in spaced relation to internal surfaces of the dies to define flow guide means for the coating materials.

The wires to be coated are moved longitudinally through the respective axial bores, passing through the tip holders and tips, being axially guided by bores of slightly larger diameters than the wires in forward portions of the tips. An annular groove extends about the periphery of each tip holder, each groove being positioned inwardly adjacent the corresponding radial bore in the body. The forward portions of the outer surfaces of the tip holders are spaced from internal surface portions of the axial bores in the body to provide a flow guide communicating with the flow guide means between the tip and the die. The coating materials exit through an annular orifice formed by the front ends of the tip and die to form uniform coating layers on the wires as they exit the front ends of the tips.

All of the above features are essentially the same as structural elements and relationships found in the cross-head die apparatus disclosed in applicant's prior U.S. Pat. Nos. 5,031,568 and 5,316,583. In addition to being adapted to applying coatings simultaneously to two wires in a single cross-head body portion, the apparatus of the present invention is distinguished by the provision of means for applying a portion of the coating material which enters through the radial bore into one of the axial bores as part of the coating layer on the wire moving through the other axial bore. This is accomplished in the disclosed embodiment by providing an internal conduit in the body portion through which the two axial bores communicate, and causing a portion of the coating material in one axial bore to pass through the conduit into the other axial bore.

Conventional means are provided to control the pressures at which the coating materials are injected through the radial bores. By applying a greater pressure to one of the materials, a portion of that material will pass through the internal conduit and enter the other axial bore. The internal conduit is formed as a bore coaxial with the two radial bores, whereby opposite ends of the conduit are inwardly adjacent the axial grooves in the tip holders. Thus, the coating material which passes from one axial bore to the other forms a longitudinal portion of the coating layer on the wire passing through the other axial bore.

Another feature of the apparatus is the arrangement of the longitudinal axes of the axial bores in angular relationship, converging toward a point forwardly of the body. Rearwardly facing surface portions of the tip holders are flush with the rear surface of the body portion at the edges of the tip holders remote from the centerline of the body. However, since these tip holder surfaces are perpendicular to the longitudinal axes of the tip holders, which forwardly converge with respect to the body centerline, the tip holder rear surfaces closest to the body centerline extend a small distance outwardly of the rear surface of the body portion. This dimensional difference is accommodated by a concave surface of a retaining plate which engages the rearwardly facing surfaces of the tip holders and the body. The retaining plate is removably held in place by a collar which is threadedly engaged with the body at its rearward periphery.

The foregoing and other features of the apparatus and method of the invention will be more clearly understood and fully appreciated from the following detailed description, taken in conjunction with the accompanying drawings.

DETAILED DESCRIPTION

Figure 3:
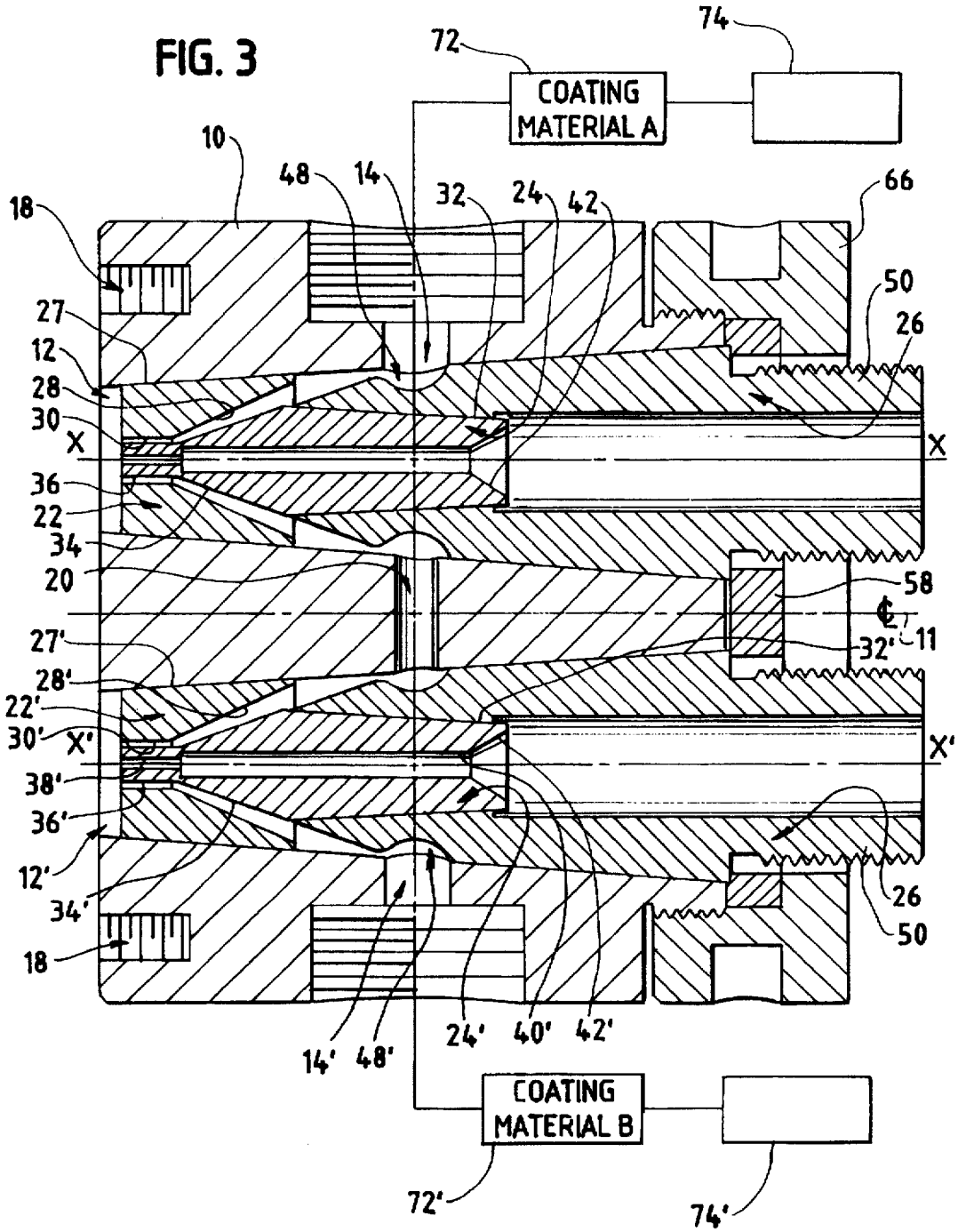
FIGS. 3 and 4 are elevational views in section on the lines 3—3 and 4—4, respectively, of FIG. 2, FIG. 3 being partly diagrammatic.
Figure 4:
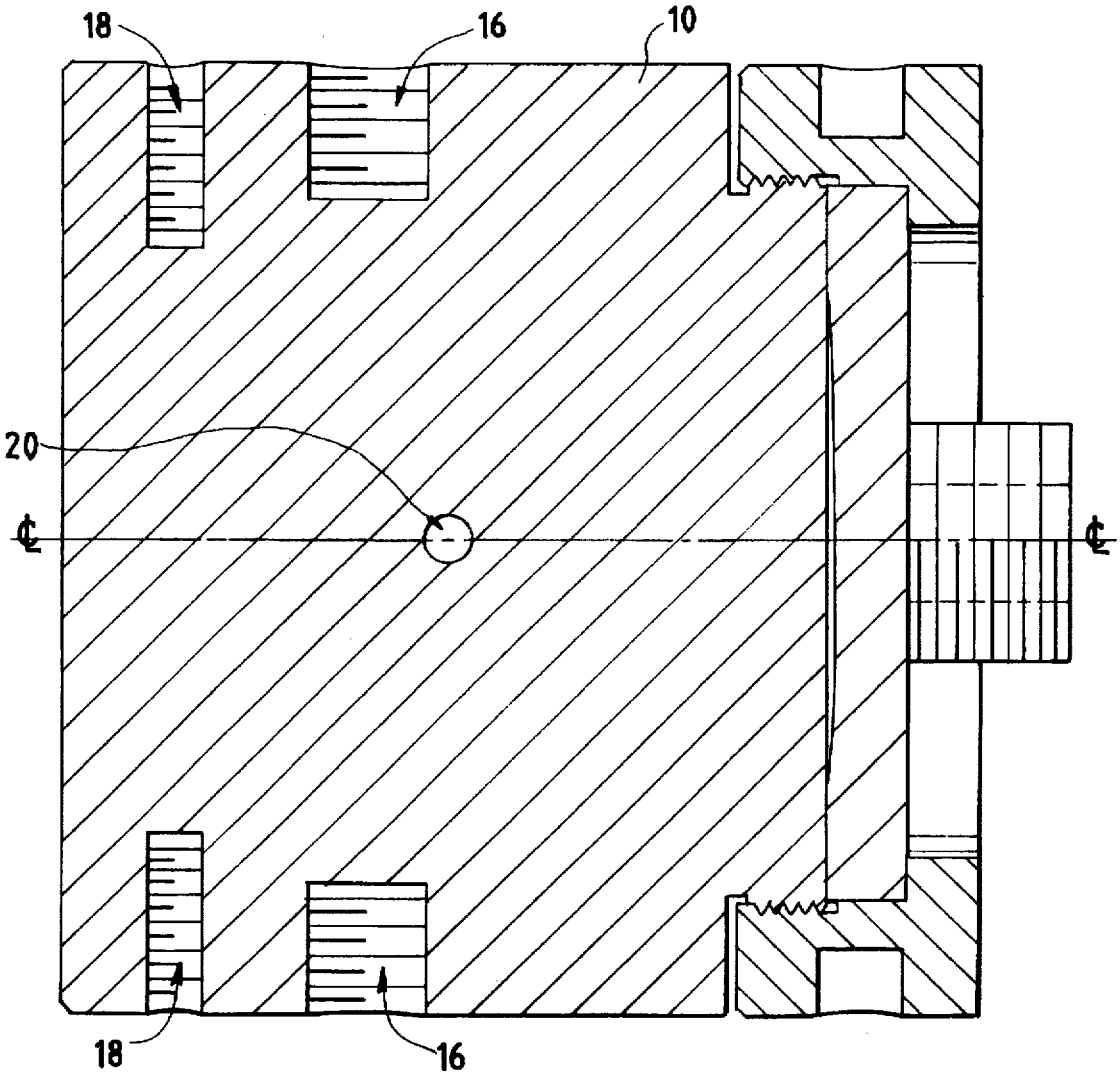

The cross-head die apparatus of the invention comprises a cylindrical body portion 10 having a central, longitudinal axis or centerline 11, conventionally so designated in FIGS. 3 and 4. Body 10 is formed from a unitary piece of appropriate metal or alloy, machined to include a pair of axially extending, through bores 12 and 12', laterally spaced from one another on opposite sides of the centerline 11. Although bores 12 and 12' are referred to as extending axially of body 10, the bores have respective longitudinal axes X—X and X'—X' which preferably are not parallel to the central axis of body 10. Rather, axes X—X and X'—X' converge at a relatively small angle, e.g., 5° or less, toward a point forwardly of what is termed the front end of the apparatus, i.e., the end on the left side as seen in FIG. 3, for reasons which will be explained later.

Body 10 is also provided with a pair of radially extending bores 14, 14', coaxially positioned on diametrically opposite sides of body 10 to communicate with axial bores 12, 12', respectively. Radial bores 14, 14' include enlarged, internally threaded, outer portions 15, 15' for engagement therein of hoses through which flowable coating material passes, as explained later.

Internally threaded openings 16 are provided on opposite sides of body 10 to receive structure for supporting the apparatus in conventional fashion, and openings 18 are provided at desired locations for mounting thermocouples, or the like, as is also conventional in cross-head die apparatus. As seen in FIGS. 3 and 4, body 10 is further provided with an internal conduit in the form of bore 20, coaxial with radial bores 14, 14', through which axial bores 12, 12' mutually communicate.

Figure 5:
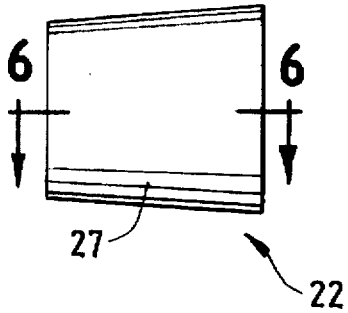
FIG. 5 is a side elevational view of one of the elements of the apparatus.
Figure 6:
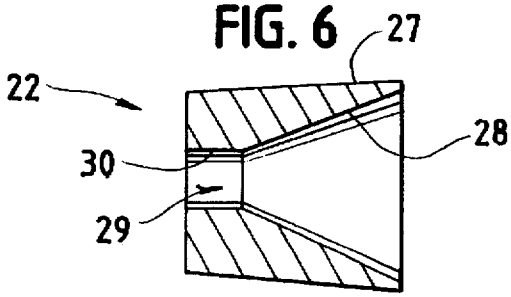
FIG. 6 is an elevational view in section on the line 6—6 of FIG. 5.

Configured for mounting in axial bore 12, from front to rear, are elements termed a die 22, a tip 24 and a tip holder 26. Respectively identical die 22', tip 24', tip holder 26' are configured for mounting in bore 12'. Die 22 is hereinafter described. However, as first stated, die 22' is identical thereto. As seen in FIGS. 5 and 6, die 22 consists of a unitary piece having a truncated conical outer surface 27 tapering inwardly from rear to front with through, axial bore 29 including rear, tapered portion 28 and forward, cylindrical portion 30. The tapered portion tapers inwardly from the rear to the cylindrical portion 30.

Figure 7:
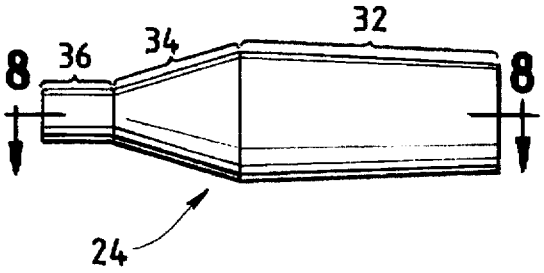
FIG. 7 is a side elevational view of another of the elements of the apparatus.
Figure 8:
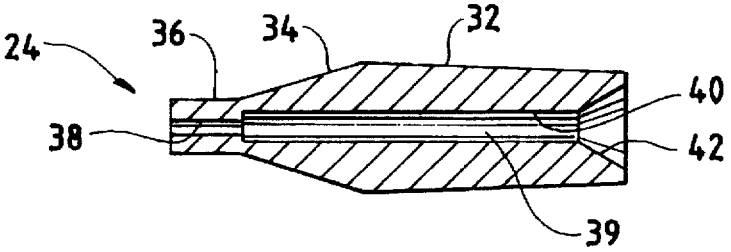
FIG. 8 is an elevational view in section on the line 8—8 of FIG. 7.

Tip 24, as seen in FIGS. 7 and 8, includes rear external surface portion 32 tapering outwardly from front to rear, and forward, cylindrical external surface portion 36' intermediate frustro-conical external surface portion 34 tapering inwardly from rear surface 32 to forward surface 36. Tip 24 also has a through axial bore 39 including a front cylindrical portion 38 with a smaller and an intermediate cylindrical portion 40 with a larger diameter and outwardly flared rear portion 42 flaring outwardly from intermediate cylindrical portion to the rear of tip 24.

Figure 1:
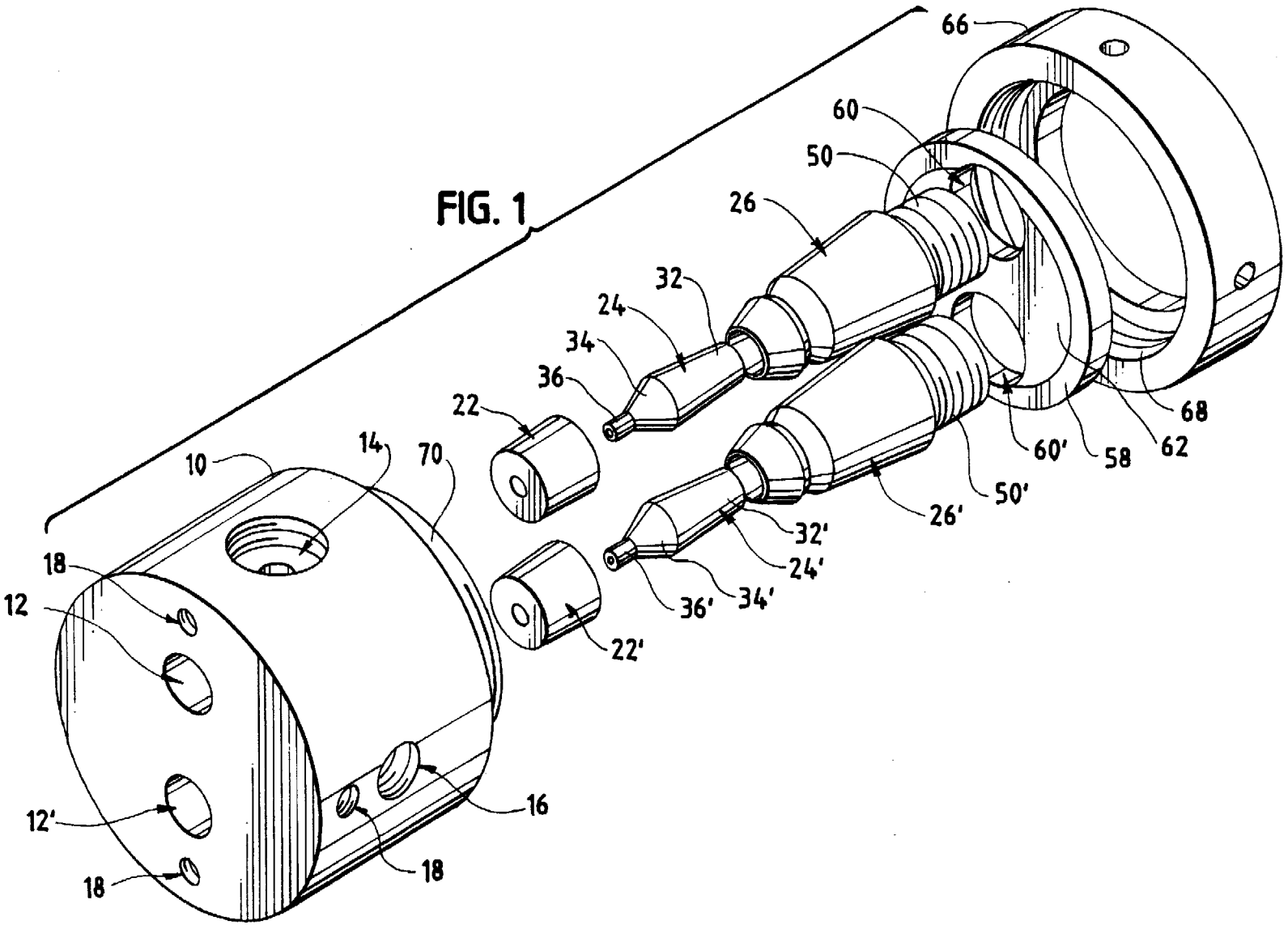
FIG. 1 is an exploded perspective view of a preferred embodiment of the cross-head die apparatus of the invention.
Figure 2:
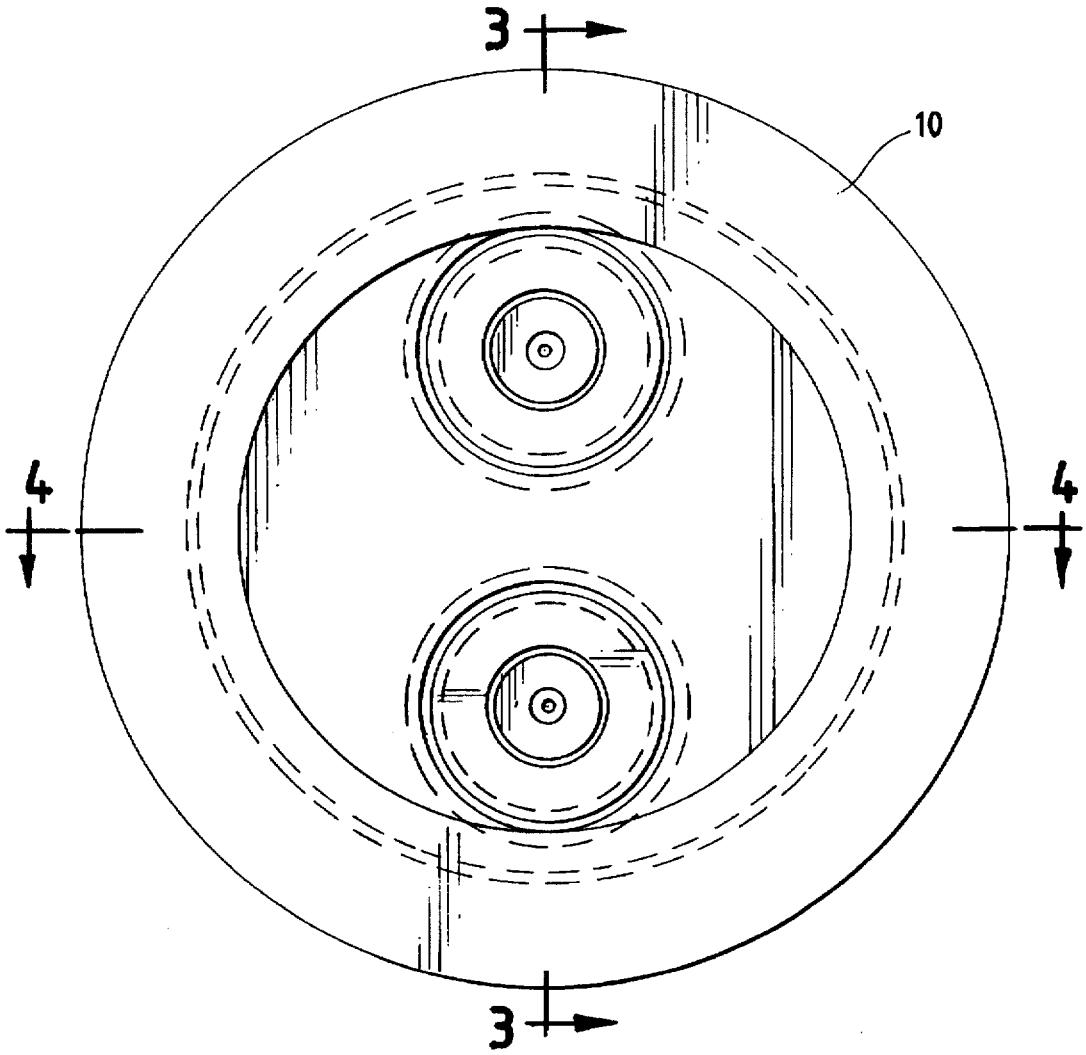
FIG. 2 is a front elevational view of the apparatus of FIG. 1, with the parts in fully assembled relation.

Referring to FIGS. 1 and 3, die 22' is identical to die 22 and tip 24' is identical to tip 24'. Also, their respective items 27', 28', 30', 32', 34', 36', 38', 40' and 42' are identical to items 27, 28, 30, 32, 34, 36, 38, 40 and 42 (FIGS. 5–8).

Figure 9:
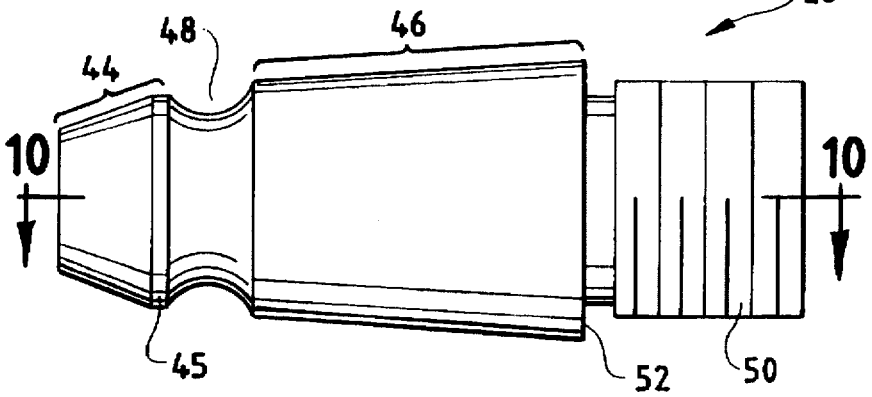
FIG. 9 is a side elevational view of a third of the elements of the apparatus.
Figure 10:
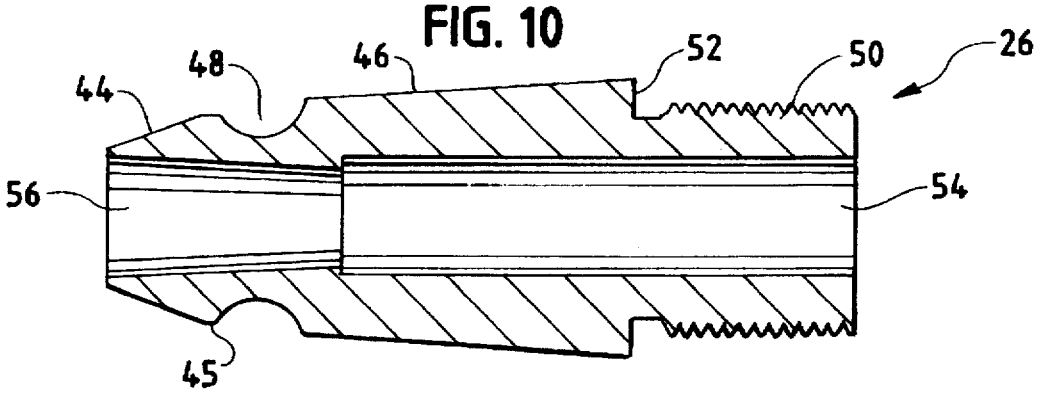
FIG. 10 is an elevational view in section on the line 10—10 of FIG. 9.

Tip holder 26 is a unitary piece illustrated in FIGS. 9 and 10. Tip holder 26 has a first section with an outer surface 44 tapering outwardly from front (left side) to rear, a second section with an outer cylindrical surface 45 extending from the rear of cylindrical surface 44. A third section with an outer annular groove or annular concave surface 48 extends from the rear of cylindrical surface 45 and interconnects the cylindrical surface 45 with a fourth section having an outer surface 46 tapering outwardly from the concave surface 48 to its rear. Extending from the rear end 52 of the fourth section is a cylindrical section 49 having an externally threaded, cylindrical portion 50 extending rearwardly. The end surface 52 lies in a plane perpendicular to the longitudinal axis of tip holder 26 at the rear terminus of surface portion 46. Tip holder 26 also includes a through axial bore having rear, cylindrical portion 54 and forward portion 56 tapering inwardly from front to rear.

Referring to FIGS. 1 and 3, tip holder 26' is identical to tip holder 26 and items 44', 45', 46', 56', 54' and 56' are identical to 44, 45, 46, 50, 54 and 56.

The elements are shown in fully assembled relation in the sectional view of FIG. 3. Dies 22, 22' are first inserted into bores 12, 12' from the rear ends thereof and moved forwardly to the positions shown wherein the opposing, tapered surfaces of the dies and bores are in mating engagement. Tips 24, 24' are inserted into the front ends of the axial bores in tip holders 26, 26' to place external surface portions 32, 32' in mating engagement with surface portions 56, 56'. Tip holders 26, 26' are then advanced into the rear ends of bores 12, 12' until surface portions 46, 46' are in mating engagement with the rear portions of the internal surface of bones 12, 12'.

Figure 11:
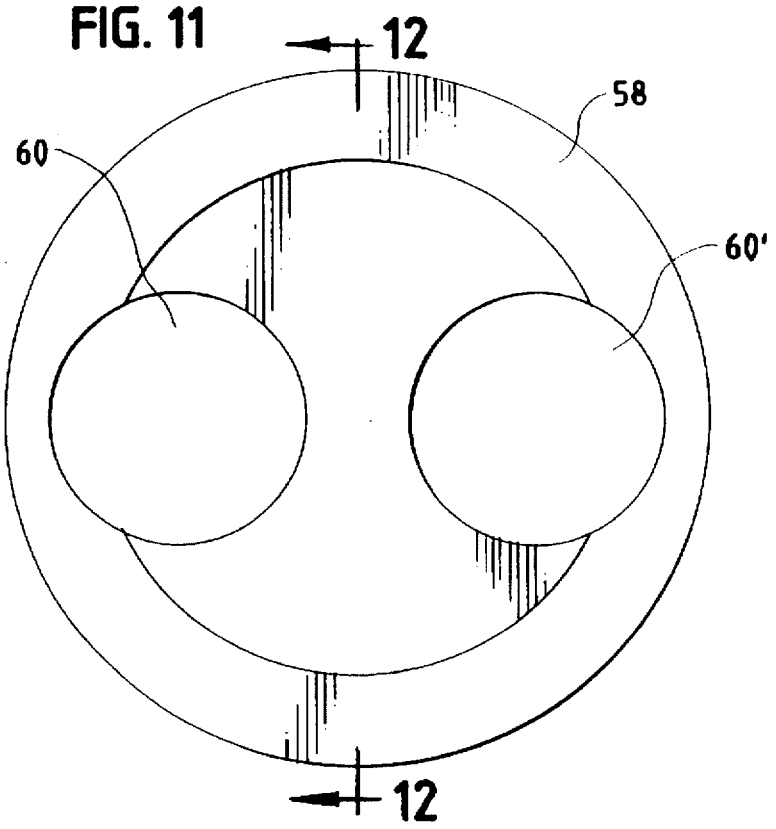
FIG. 11 is a front elevational view of a fourth of the elements of the apparatus.
Figure 12:
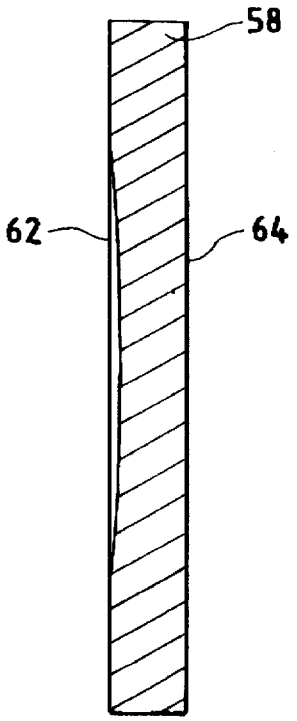
FIG. 12 is an elevational view in section on the line 12—12 of FIG. 11.

The tip holders are retained against rearward movement in bores 12, 12' by retaining plate 58, shown separately in FIGS. 11 and 12. Plate 58 is formed with a pair of through openings 60, 60' having diameters somewhat larger than those of threaded portions 50, 50' of the tip holders. Plate 58 is placed in covering relation to the rearwardly facing surface of body 10 which surrounds the rear ends of bores 12, 12' with surfaces 62 and 64 of plate 58 facing forwardly and rearwardly, respectively. Collar 66 includes internally threaded portion 68 for mating engagement with external threads 70 (FIG. 1) surrounding the rearwardly facing surface of body 10 to releasably retain plate 58 in place.

The rearwardly facing surface of body 10, surrounding the rear ends of bores 12, 12', is perpendicular to the longitudinal centerline of body 10, whereas surfaces 52, 52' of tip holders 26, 26' are perpendicular to axes X—X and X'—X' of bores 12, 12'. That is, the longitudinal axes and axial bores of the dies, tip and tip holders are coaxial with the axes of the bores in which they are positioned. Thus, since axes X—X and X'—X' are not parallel with the centerline 11 of body 10, as previously explained, surfaces 52, 52' of the tip holders are not coplanar with the rearwardly facing surface of body 10. Rather, the parts are so dimensioned that surface 52, 52' are essentially flush at their edges remote from the body centerline With the adjacent portions of the rearwardly facing surface of body 10. Therefore, the portions of tip holders 26, 26' closest to the body centerline project a small distance (since the angle between the bore axes is relatively small) rearwardly of the adjacent portions of the body rear surface.

It will be noted that surface 62 of plate 58 is formed with a slight concavity. Thus, concave surface 62 is spaced from the plane of the opposing rearwardly facing surface of body 10 by an increasing distance from the periphery toward the center of plate 58. This spacing accommodates the portions of tip holders 26, 26' which extend rearwardly of body 10, whereby the tip holders are firmly engaged substantially entirely about surfaces 52, 52' by plate 58 when collar 66 is securely threaded to the body.

With the dies, tips and tip holders so positioned in bores 12, 12', annular grooves 48, 48' are directly, inwardly adjacent the inner ends of radial bores 14, 14'. As previously mentioned, hoses or other conduit means connect radial bores 14, 14' to respective sources, diagrammatically indicated at 72 and 72' in FIG. 3, of flowable coating materials A and B. Conventional means, denoted by reference numerals 74 and 74' are provided in association with coating material sources 72 and 72', respectively, to control the pressures at which the coating materials are supplied to radial bores 14, 14'.

From the radial bores, coating materials A and B enter axial bores 12 and 12', respectively, and annular grooves 48, 48' of tip holders 26, 26'. By creating a differential between the pressures at which coating materials A and B are injected, some of the coating material injected into one of the axial bores will pass through internal conduit 20 into the other axial bore. For example, if a greater pressure is applied to material A than to material B, a portion of material A will flow through conduit 20 and enter annular groove 48'.

The materials in annular grooves 48, 48' flow forwardly from the grooves, through the spaces between external surface portions 44, 44' of the tip holders and the opposing internal surface portions of bores 12, 12', and through the flow guide means between opposing outer surface portions of tips 24, 24' and the internal surfaces of the bores of dies 22, 22'. The coating materials exit the apparatus in tubular form through the annular orifices provided by the spacing between the forward ends of tip portions 36, 36' and bore portions 30, 30' of dies 22, 22'. The coating materials are deposited in uniform layers on wires which are moved axially through the apparatus, normally from supply rolls of bare wire to take-up rolls of coated wire, guided along axes X—X and X'—X' by bore portions 38, 38' of tips 24, 24'.

Figure 13:
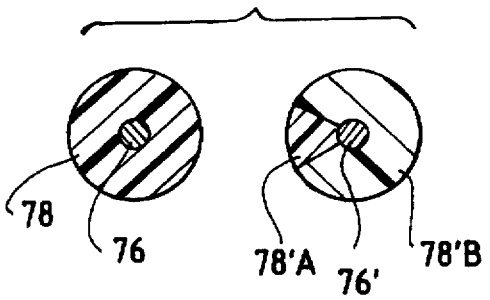
FIG. 13 is a front elevational view, in section, showing a typical pair of wires with coating layers applied by the apparatus and method of the invention.

Referring now to FIG. 13, a pair of wires coated in a manner typical of the invention are shown in radial section. Electrical conductors 76, 76' represent wires which have been moved axially through the cross-head die apparatus in the manner previously described. Coating layer 78 on conductor 76 consists entirely of coating material A, e.g., a black material. The coating layer on conductor 76' includes first and second portions 78'A and 78'B consisting of coating materials A and B, respectively. Coating material B. e.g., a white material, is visually distinguishable from coating material A, whereby coating material A will appear as a longitudinal stripe in the coating layer on conductor 76'.

From the foregoing, it will be seen that the present invention provides a unique and effective method, and apparatus for implementation thereof, for simultaneously producing a plurality of coated filament members with visually distinct coating layers in a single cross-head die. The portion of one coating material which passes from one axial bore to the other, assuming the flow passages through the two bores are of equal cross-sectional area, is a function of the differential in the pressures at which the coating materials are injected. Of course, if coating layers of different thickness are desired, the flow passages or guide means for the coating materials will be different in the two bores and a portion of the material from the bore having the more restricted flow guide will migrate to the other bore without a pressure differential. Other factors, such as differences in viscosity of the coating materials may also influence passage of one coating material from one to the other of the axial bores to form a desired portion of the coating layer in the other bore.

What is claimed is:

1. Cross-head die apparatus for applying coating materials to at least two elongated, filament members as they are moved longitudinally through said apparatus, comprising:

a) a body portion having:

i) first and second, laterally spaced, through, axial passageways, having respective front and rear ends;

ii) first and second radial passageways communicating between an interior of said body portion and interiors of said first and second axial passageways, respectively; and iii) internal conduit means through which said first and second axial passageways mutually communicate;

b) first and second guide means respectively positioned within said first and second axial passageways to establish respective longitudinal paths of travel of said filament members through said axial passageways;

c) means positioned within said first and second axial passageways defining first and second, respective, annular flow paths for directing first and second flowable coating materials from said first and second radial passageways, through said first and second axial passageways to exit said front ends in covering relation to said filament members; and d) flow control means connected to said first radial passageway for causing a portion of said first coating material to flow through said conduit means from said first to said second axial passageway to form a portion of the coating on the filament member passing through said second axial passageway.

2. The apparatus of claim 1 wherein said means positioned said first and second axial passageways comprise respective first and second tip members, and first and second die members cooperatively arranged within said first and second axial passageways.

3. The apparatus of claim 2 wherein said first and second guide means comprise respective, longitudinal bores extending through said first and second tip members.

4. The apparatus of claim 1 wherein said first and second axial passageways have respective, linear, longitudinal axes which converge toward a point of intersection forwardly of said front ends.

5. The apparatus of claim 4 wherein said axes converge at an angle of not more than about 5°.

6. The apparatus of claim 1 wherein said flow control means comprises means for delivering said first coating material to said first axial passageway at a higher pressure than the pressure at which said second coating material is delivered to said second axial passageway.

7. The apparatus of claim 6 wherein said flow control means comprises means for selectively varying the pressure at which each of said first and second coating materials are delivered to said first and second axial passageways.

8. The apparatus of claim 1 wherein said body portion has a longitudinal centerline and said first and second axial passageways are positioned on opposite sides of said centerline.

9. The apparatus of claim 8 wherein said first and second annular flow paths are substantially equal in area in all common planes perpendicular to said centerline.

10. The apparatus of claim 1 wherein said first and second radial passageways and said conduit means are coaxial.

* * * * *

UNITED STATES PATENT AND TRADEMARK OFFICE

CERTIFICATE OF CORRECTION

PATENT NO. : 5,665,161
DATED : September 9, 1997
INVENTOR(S) : James A. Milliman; Gary G. Thuot It is certified that error appears in the above-indentified patent and that said Letters Patent is hereby corrected as shown below:

Column 4, Line 43, delete "tip 24' is identical to tip 24'" and insert --tip 24 is identical to tip 24'--.

Column 5, Line 35, delete "With" and insert --with--.

Column 7, Line 13-14, delete "positioned said first" and insert --positioned within said first--.

Signed and Sealed this

Twenty-third Day of December, 1997

Bruce Lehman

*Attest:*

BRUCE LEHMAN

*Attesting Officer*

*Commissioner of Patents and Trademarks*